US010625932B2

(12) United States Patent
Chatelain

(10) Patent No.: US 10,625,932 B2
(45) Date of Patent: Apr. 21, 2020

(54) CONTAINER HAVING AN INNER FRAME WITH A SPACED BACK WALL, CORRESPONDING INNER FRAME AND REEL

(71) Applicant: PHILIP MORRIS PRODUCTS S.A., Neuchatel (CH)

(72) Inventor: Lucas Chatelain, Lausanne (CH)

(73) Assignee: Philip Morris Products S.A., Neuchatel (CH)

( * ) Notice: Subject to any disclaimer, the term of this patent is extended or adjusted under 35 U.S.C. 154(b) by 223 days.

(21) Appl. No.: 15/531,086

(22) PCT Filed: Dec. 22, 2015

(86) PCT No.: PCT/EP2015/081092
§ 371 (c)(1),
(2) Date: May 26, 2017

(87) PCT Pub. No.: WO2016/102630
PCT Pub. Date: Jun. 30, 2016

(65) Prior Publication Data

US 2017/0327305 A1 Nov. 16, 2017

(30) Foreign Application Priority Data

Dec. 23, 2014 (EP) ..... 14200027

(51) Int. Cl.
*A24F 15/06* (2006.01)
*B65D 85/10* (2006.01)
(Continued)

(52) U.S. Cl.
CPC ..... *B65D 85/1045* (2013.01); *B65D 5/02* (2013.01); *B65D 5/4266* (2013.01);
(Continued)

(58) Field of Classification Search
CPC ..... B65D 85/1054; B65D 85/1009; B65D 85/1045; B65D 85/10; B65D 85/1036;
(Continued)

(56) References Cited

U.S. PATENT DOCUMENTS 5,129,513 A 7/1992 Wallace
5,480,025 A 1/1996 Draucker
(Continued)

FOREIGN PATENT DOCUMENTS

CN 1397239 2/2003
CN 101072711 11/2007
(Continued)

OTHER PUBLICATIONS

Office Action issued in China for Application No. 201580068061.4 dated Aug. 29, 2018 (10 pages). English translation included.
(Continued)

*Primary Examiner* — Allan D Stevens
(74) *Attorney, Agent, or Firm* — Mueting, Raasch & Gebhardt, P.A.

(57) ABSTRACT

A container for consumer goods is provided, the container including a box portion and a lid portion depending along a hinge line from a top edge of the box portion. An inner frame is slidably received within the box portion, the inner frame including an inner frame front panel, and first and second inner frame side panels each depending along an inner frame side panel fold line from first and second inner frame front panel side edges respectively. Each of the first and second inner frame side panels includes a back edge spaced apart from the respective inner frame side panel fold line. The inner frame further includes first and second inner frame back panels each depending along a respective inner frame back panel fold line from the first and second inner frame side panels respectively.

13 Claims, 4 Drawing Sheets

(51) Int. Cl.
*B65D 5/02* (2006.01)
*B65D 5/42* (2006.01)
*B65D 5/50* (2006.01)
*B65D 5/66* (2006.01)

(52) U.S. Cl.
CPC ..... *B65D 5/5035* (2013.01); *B65D 5/662* (2013.01); *B65D 85/1081* (2013.01)

(58) Field of Classification Search
CPC ..... B65D 85/1063; B65D 85/1081; B65D 5/5246; B65D 5/522; B65D 5/5213; A24F 15/06
USPC ..... 206/250, 251
See application file for complete search history.

(56) References Cited

U.S. PATENT DOCUMENTS

| | | | | |
|---|---|---|---|---|
| 7,832,556 | B2 | 11/2010 | Ghini | |
| 8,136,662 | B2 | 3/2012 | Aeschlimann | |
| 2003/0029746 | A1 | 2/2003 | Draghetti | |
| 2003/0173249 | A1 | 9/2003 | Nemoto | |
| 2003/0179249 | A1 | 9/2003 | Sauer | |
| 2013/0098786 | A1* | 4/2013 | Collins | A23G 3/0231 206/268 |

FOREIGN PATENT DOCUMENTS

| | | | | |
|---|---|---|---|---|
| DE | 8607391 | | 8/1987 | |
| EP | 2138411 | | 12/2009 | |
| EP | 2754622 | | 7/2014 | |
| EP | 3107831 | B1 * | 9/2017 | B65D 85/1045 |
| JP | S58-084266 | | 12/1984 | |
| JP | H05-262349 | | 2/2002 | |
| RU | 2415797 | | 4/2011 | |
| WO | WO 2011/051076 | | 5/2011 | |
| WO | WO 2011/053176 | | 5/2011 | |
| WO | WO 2011/060795 | | 5/2011 | |
| WO | WO 2013/056827 | | 4/2013 | |
| WO | WO 2013/076863 | | 5/2013 | |
| WO | WO 2013/131616 | | 9/2013 | |
| WO | WO 2014/190122 | | 11/2014 | |
| WO | WO 2015/124974 | | 8/2015 | |
| WO | WO-2016063247 | A1 * | 4/2016 | B65D 85/1009 |
| WO | WO-2016103208 | A1 * | 6/2016 | B65D 85/1045 |
| WO | WO-2017017644 | A1 * | 2/2017 | B65D 85/1009 |
| WO | WO-2017017645 | A1 * | 2/2017 | B65D 85/1009 |

OTHER PUBLICATIONS

International Search Report and Written Opinion for PCT/EP2015/081092 dated Mar. 30, 2016 (12 pages).
Search Report in Europe for Application No. 14200027.2 dated Jun. 15, 2012 (5 pages).
Office Action issued in Japan for Application No. 2017-533529 dated Sep. 24, 2019 (3 pages). English translation included.
Office Action issued in Russia for Application No. 2017126221 dated Mar. 27, 2019 (20 pages). English translation included.

* cited by examiner

CONTAINER HAVING AN INNER FRAME WITH A SPACED BACK WALL, CORRESPONDING INNER FRAME AND REEL

This application is a U.S. National Stage Application of International Application No. PCT/EP2015/081092, filed Dec. 22, 2015, which was published in English on Jun. 30, 2016, as International Publication No. WO 2016/102630A1. International Application No. PCT/EP2015/081092 claims priority to European Application No. 14200027.2 filed Dec. 23, 2014.

The present invention relates to a container for consumer goods, the container having an inner frame received within a box portion, wherein a back wall of the inner frame is spaced from a back wall of the box portion. Containers according to the present invention find particular application as containers for elongate consumer goods, such as aerosol-generating articles.

It is known to package elongate aerosol-generating articles and other consumer goods in containers formed from folded laminar blanks. Elongate aerosol-generating articles, such as cigarettes and cigars, are commonly sold in hinge-lid packs having a box for housing the aerosol-generating articles and a lid connected to the box about a hinge line extending across the back wall of the container. The hinge-lid pack may also comprise an inner frame secured to an inner surface of the box, the inner frame having front and side walls against which the lid closes. Such packs are typically constructed from laminar cardboard blanks. In use, the lid is pivoted about the hinge line to open the pack and so gain access to the aerosol-generating articles held in the box.

In some cases, there is a need to provide containers that are larger in size than the volume occupied by the consumer goods within the container. This may result in there being empty space within the container so that the consumer goods are more likely to be displaced or shaken within the container during transport.

It would be desirable to provide a novel container for consumer goods that substantially retains the consumer goods in position within the container, where the consumer goods occupy only a portion of the internal space of the container. It would be further desirable to provide such a container that facilities removal of consumer goods from the container when the container is opened. It would be particularly desirable to provide such a container that can be readily produced without significant modification of existing container designs or packaging equipment.

According to a first aspect of the present invention there is provided a container for consumer goods, the container comprising a box portion comprising a box portion front wall, a box portion back wall, first and second box portion side walls, and a box portion bottom wall. The container also comprises a lid portion depending along a hinge line from a top edge of the box portion, wherein the lid portion is moveable about the hinge line between an open position and a closed position. An inner frame is slidably received within the box portion, the inner frame comprising an inner frame front panel comprising first and second side edges, and first and second inner frame side panels each depending along an inner frame side panel fold line from the first and second inner frame front panel side edges respectively. Each of the first and second inner frame side panels comprises a back edge spaced apart from the respective inner frame side panel fold line. The inner frame further comprises first and second inner frame back panels each depending along a respective inner frame back panel fold line from the first and second inner frame side panels respectively, wherein the first and second inner frame back panels form at least part of an inner frame back wall. A distance between each of the inner frame back panel fold lines and the respective inner frame side panel fold line is less than a maximum width of the respective inner frame side panel between the inner frame side panel fold line and the inner frame side panel back edge so that the minimum spacing between the inner frame front panel and the inner frame back wall is less than the maximum width of each inner frame side panel. A portion of the inner frame back wall is connected to the lid portion so that, when the lid portion is moved about the hinge line, the inner frame slides within the box portion between a raised position when the lid portion is in the open position and a lowered position when the lid portion is in the closed position.

As used herein the terms "side", "top", "bottom", "front", "back" and other terms used to describe relative positions of the components of containers according to the invention refer to the container in an upright position with the lid portion at the top and the box portion bottom wall at the bottom. When describing containers according to the present invention, these terms are used irrespective of the orientation of the container being described.

As used herein the term "hinge line" refers to a line about which two elements may be pivoted relative to each other. A hinge line may be, for example, a fold line, a perforation line or a score line in a wall or panel of the container. Where the hinge line is a perforation line, the perforation line may be used to remove parts of the container.

The term "panel" is used herein to refer to a portion of the container formed from a single, continuous portion of material. A panel may depend along one or more fold lines from one or more other panels. The term "flap" refers to a panel that depends along only one fold line from only one other panel.

The term "wall" refers more generally to a facet of the container, and a wall may be formed from a single panel or flap, or a wall may be formed from two or more abutting or overlapping panels or flaps.

Containers according to the present invention comprise an inner frame having a minimum spacing between an inner frame front panel and an inner frame back wall that is less than a maximum width of the inner frame side panels. Therefore, the inner frame back wall is advantageously spaced apart from the box portion back wall so that the inner frame defines a volume for receiving consumer goods between the inner frame front panel and the inner frame back wall, wherein the volume is less than the full volume of the container. Therefore, containers according to the present invention advantageously enable consumer goods that occupy less space than the full volume of the container to be held in place more securely within the box portion. Movement of the consumer goods within the container can therefore be minimised during storage to prevent damage to the consumer goods. Elongate consumer goods, such as aerosol-generating articles, may advantageously be held in an upright position and in substantial alignment with each other in order to facilitate access and removal of the consumer goods from the container.

Furthermore, containers according to the present invention comprise a portion of the inner frame back wall connected to the lid portion so that, when the lid portion is moved about the hinge line, the inner frame slides within the box portion. Therefore, opening the lid portion advantageously slides the inner frame into a raised position, which can facilitate easier access to the consumer goods within the container. For example, the inner frame may comprise a bottom wall which pushes the consumer goods upward into a more accessible position when the inner frame slides into the raised position. Additionally, or alternatively, the consumer goods may be contained within a wrapper, for example, wherein a portion of the wrapper is adhered to the inner frame so that the wrapper and the consumer goods contained therein move upward when the inner frame slides into the raised position.

Advantageously, the configuration of containers according to the present invention, and in particular the construction of the inner frame, is such that they facilitate manufacture of the container on existing high speed manufacturing and packaging machines with minimal modification.

The first and second inner frame back panels may be spaced apart from each other, or they may abut each other. Alternatively, the first and second inner frame back panels preferably at least partially overlap each other. Overlapping the first and second inner frame back panels provides a double thickness for at least a portion of the inner frame back wall, which provides increased strength to the inner frame back wall. In particularly preferred embodiments, a width of each of the first and second inner frame back panels is substantially the same as the distance between the first and second inner frame side panels so that the first and second inner frame back panels overlap each other over substantially the entire surface of each of the first and second inner frame back panels.

In any of the embodiments described above, at least one of the first and second inner frame back panels may form the portion of the inner frame back wall connected to the lid portion. For example, in those embodiments in which the first and second inner frame back panels overlap each other, the inner frame back panel adjacent the lid portion may be connected to the lid portion.

Alternatively, in some embodiments the first and second inner frame back panels form a lower portion of the inner frame back wall, the inner frame further comprising first and second inner frame end panels each extending along an inner frame end panel fold line from a top edge of the first and second inner frame back panels respectively, wherein the first and second inner frame end panels form an upper portion of the inner frame back wall, and wherein the upper portion of the inner frame back wall is the portion of the inner frame back wall connected to the lid portion. Providing an upper portion of the inner frame back wall that is connected to the lid portion and depends along a fold line from a lower portion of the inner frame back wall provides an articulation in the inner frame back wall that may facilitate the required movement of the inner frame back wall during opening and closing of the lid portion in those embodiments in which the inner frame back wall is constructed from a relatively stiff material.

In those embodiments in which the inner frame comprises first and second inner frame end panels, the first and second inner frame end panels preferably at least partially overlap each other, most preferably substantially completely overlap each other. Overlapping the first and second inner frame end panels provides a double thickness for at least part of the upper portion of the inner frame back wall, which provides increased strength to the inner frame back wall.

In further alternative embodiments, the first and second inner frame back panels may form a lower portion of the inner frame back wall, the inner frame further comprising first and second inner frame intermediate panels each extending along an inner frame intermediate panel fold line from a top edge of the first and second inner frame back panels respectively, wherein the first and second inner frame intermediate panels form an intermediate portion of the inner frame back wall. In such embodiments, the inner frame further comprises first and second inner frame end panels each extending along an inner frame end panel fold line from a top edge of the first and second inner frame intermediate panels respectively, wherein the first and second inner frame end panels form an upper portion of the inner frame back wall, and wherein the upper portion of the inner frame back wall is the portion of the inner frame back wall connected to the lid portion.

Providing an intermediate portion of the inner frame back wall that depends along a fold line from a lower portion of the inner frame back wall and an upper portion of the inner frame back wall that depends along a fold line from the intermediate portion of the inner frame back wall provides two articulation points in the inner frame back wall. Providing the inner frame back wall with two articulation points optimises the translation of rotational movement of the lid portion into a translational sliding movement of the inner frame during opening and closing of the lid portion. Providing the inner frame back wall with two articulation points may also facilitate the required movement of the inner frame back wall during opening and closing of the lid portion in those embodiments in which the inner frame back wall is constructed from a relatively stiff material.

In those embodiments in which the inner frame comprises first and second inner frame intermediate panels and first and second inner frame end panels, the first and second inner frame intermediate panels preferably at least partially overlap each other, most preferably substantially completely overlap each other. Additionally, or alternatively, the first and second inner frame end panels preferably at least partially overlap each other, most preferably substantially completely overlap each other. Overlapping the first and second inner frame intermediate panels provides a double thickness for at least part of the intermediate portion of the inner frame back wall, which provides increased strength to the inner frame back wall. Similarly, overlapping the first and second inner frame end panels provides a double thickness for at least part of the upper portion of the inner frame back wall, which provides increased strength to the inner frame back wall.

Additionally, or alternatively, the inner frame end panel fold lines are preferably positioned below the hinge line between the lid portion and the box portion when the lid portion is in the closed position. Positioning the inner frame end panel fold lines below the hinge line provides optimum translation of the rotational movement of lid portion during opening and closing of the lid portion into the translational sliding movement of the inner frame.

In any of the embodiments described above, the minimum spacing between the inner frame front panel and the inner frame back wall is preferably less than about 80 percent of the spacing between the box portion front wall and the box portion back wall, preferably less than about 70 percent of the spacing between the box portion front wall and the box portion back wall. Providing such a spacing between the inner frame front panel and the inner frame back wall provides sufficient space between the box portion back wall and at least a portion of the inner frame back wall to facilitate the sliding movement of the inner frame when the lid portion is moved between the open and closed positions.

In any of the embodiments described above, the portion of the inner frame back wall that is connected to the lid portion may be formed integrally with at least part of the lid portion. Alternatively, the portion of the inner frame back wall that is connected to the lid portion may be formed separately from the lid portion and subsequently connected thereto. For example, a portion of the inner frame back wall may be adhered to the lid portion using a suitable adhesive.

In any of the embodiments described above, the width of each inner frame side panel between the respective inner frame side panel fold line and the inner frame side panel back edge is preferably substantially the same as a width of the box portion side walls between an inner surface of the box portion front wall and an inner surface of the box portion back wall. Forming the inner frame with a maximum width of the inner frame side panels that is substantially the same as the width of the box portion side walls advantageously restricts movement of the inner frame to upward and downward sliding movement with respect to the box portion during opening and closing of the lid portion.

In any of the embodiments described above, the first and second inner frame side panels may each comprise a pair of spaced apart cut lines extending perpendicular to the inner frame side panel back edge, wherein each cut line extends between a proximal end at the inner frame side panel back edge and a distal end positioned between the inner frame side panel back edge and the inner frame side panel fold line, and wherein each inner frame back panel fold line extends between the distal ends of the respective pair of spaced apart cut lines. Providing such an arrangement of cut lines and fold lines provides the reduced minimum spacing between the inner frame front panel and the inner frame back wall while retaining a maximum width of the inner frame side panels that is larger than the reduced spaced between the inner frame front panel and the inner frame back wall. This is particularly advantageous in those embodiments in which the maximum width of the inner frame side panels is substantially the same as the width of the box portion side walls. Providing such an arrangement of cut lines and fold lines may also facilitate the manufacture of the container on high speed manufacturing machines.

In any of the embodiments described above, the lid portion may comprise a lid portion back wall depending along the hinge line from a top edge of the box portion back wall, and wherein the portion of the inner frame back wall connected to the lid portion is connected to the lid portion back wall. Providing a lid portion depending along a hinge line from a top edge of the box portion back wall may desirably provide the container with an external appearance of a conventional hinge lid container when the lid portion is in the closed position. Providing a lid portion depending along a hinge line from a top edge of the box portion back wall may also facilitate the manufacture of the container on existing high speed manufacturing machines with minimal modification, as well as eliminating the need to modify downstream processes, such as wrapping and packing of the containers and displaying the containers at the point of sale.

In any of the embodiments described above, the inner frame front panel preferably comprises a cut-out portion at a top edge of the inner frame front panel and a tab portion at a bottom end of the inner frame front panel, wherein the cut-out portion and the tab portion have substantially the same size and shape. Providing a cut-out portion at the top of the inner frame front panel may improve access to the consumer goods contained within the inner frame and therefore facilitate removal of the consumer goods from the container by a consumer. Furthermore, providing a corresponding tab portion at the bottom of the inner frame front panel facilitates the manufacture of multiple inner frames from a substantially continuous sheet of material. In particular, a single cut line can be used to form a tab portion of a first inner frame and a cut-out portion of a consecutive inner frame, which reduces or eliminates the generation of waste material.

In those embodiments in which the inner frame comprises a cut-out portion and a tab portion, the tab portion may form an inner frame bottom panel depending along an inner frame bottom panel fold line from a bottom edge of the inner frame front panel. In such embodiments, the inner frame bottom panel forms at least part of an inner frame bottom wall. Advantageously, the inner frame bottom wall may support the consumer goods within the inner frame and push the consumer goods upward within the container when the inner frame moves into the raised position.

In those embodiments in which the tab portion forms an inner frame bottom panel, the tab portion may further form a third inner frame back panel depending along a third inner frame back panel fold line from a back edge of the inner frame bottom panel, the third inner frame back panel connected to at least one of the first and second inner frame back panels to form part of the inner frame back wall. Advantageously, the third inner frame back panel secures the back edge of the inner frame bottom panel to the inner frame back wall to retain the inner frame bottom panel in position.

As an alternative to those embodiments in which the tab portion forms an inner frame bottom panel, the tab portion may extend parallel to the box portion front wall and form part of the inner frame front panel. Such embodiments may advantageously reduce the amount of material required to form the inner frame when compared to those embodiments in which the tab portion forms at least an inner frame bottom panel.

In any of the embodiments described above, the inner frame may further comprise at least one indicia on the inner frame front panel, wherein the at least one indicia is concealed by the box portion front wall when the inner frame is in the lowered position, and wherein the at least one indicia is revealed when the inner frame slides into the raised position. The at least one indicia may comprise at least one of a graphic and text.

In any of the embodiments described above, the inner frame is preferably formed from a first folded laminar blank and the box portion and the lid portion are preferably both formed from a second folded laminar blank. Using only two laminar blanks to form the container simplifies the manufacture of the container and facilitates manufacture of the container on existing high speed manufacturing machines with minimal modification.

Containers in accordance the present invention are preferably rectangular parallelepipeds each comprising two wider walls spaced apart by two narrower walls. The two wider walls will usually be the front and back walls and the two narrower walls will usually be the side walls.

The containers may be formed from any suitable materials including, but not limited to, cardboard, paperboard, plastic, metal, or combinations thereof. As described above, the inner frame, the box portion and the lid portion are preferably formed from folded laminar blanks. The laminar blanks are preferably formed from cardboard, most preferably cardboard having a basis weight of between about 100 grams per square metre and about 350 grams per square metre.

In some embodiments, each assembled and filled container may be wrapped in an outer wrapper. The outer wrapper is preferably a transparent polymeric film of, for example, high or low density polyethylene, polypropylene, oriented polypropylene, polyvinylidene chloride, cellulose film, or combinations thereof and the outer wrapper is applied in a conventional manner. The outer wrapper may include a tear tape. In addition, the outer wrapper may be printed with images, consumer information or other data.

As described above, containers according to the invention may be in the shape of a rectangular parallelepiped and may comprise right-angled longitudinal and right-angled transverse edges. Alternatively, the containers may comprise one or more rounded longitudinal edges, rounded transverse edges, bevelled longitudinal edges or bevelled transverse edges, or combinations thereof.

Where the container comprises one or more bevelled edges, preferably the bevelled edge has a width of between about 1 millimetre and about 10 millimetres, preferably between about 2 and about 6 millimetres. Alternatively, the container may comprise a double bevel formed by three parallel creasing or scoring lines that are spaced such that two distinct bevels are formed on the edge of the container.

Alternatively, the container may have a non-rectangular transversal cross section, for example polygonal such as triangular or hexagonal, semi-oval or semi-circular.

Preferably, containers according to the invention have a width of between about 40 millimetres and about 100 millimetres, more preferably a width of between about 50 millimetres and about 90 millimetres, wherein the width is measured from one side wall to the other side wall of the container.

Preferably, containers according to the invention have a depth of between about 6 millimetres and about 150 millimetres, more preferably a depth of between about 12 millimetres and about 25 millimetres wherein the depth is measured from the front wall to the back wall of the container.

Preferably, the ratio of the height of the container to the depth of the container is in between about 1 to 1 and about 10 to 1, more preferably between about 2 to 1 and about 8 to 1, most preferably between about 3 to 1 and about 5 to 1.

Preferably, the ratio of the width of the container to the depth of the container is in between about 1 to 1 and about 10 to 1, more preferably between about 2 to 1 and about 8 to 1, most preferably between about 2 to 1 and about 3 to 1.

In any of the embodiments described above, the container may comprise one or more consumer goods received within the inner frame between the inner frame front panel and the inner frame back wall.

In some embodiments, the one or more consumer goods comprise a bundle of aerosol-generating articles. The term "aerosol-generating article" is used herein to mean an article comprising at least one substrate that forms an aerosol when heated. As known to those skilled in the art, an aerosol is a suspension of solid particles or liquid droplets in a gas, such as air. The aerosol may be a suspension of solid particles and liquid droplets in a gas, such as air. For example, the aerosol-generating article may be an article for use in an electrically operated smoking system. In this case, the aerosol-generating article may comprise a tobacco or other nicotine-containing substrate that generates an aerosol comprising nicotine when the substrate is heated. Alternatively, the aerosol-generating article may comprise a more conventional smoking article, such as a filter cigarette.

In some embodiments, the one or more consumer goods may be wrapped in a wrapper. In those embodiments in which the inner frame does not comprise an inner frame bottom panel, at least a portion of the wrapper is preferably secured to at least a portion of the inner frame so that the one or more consumer goods is moved upward and downward within the box portion as the inner frame moves between the raised and lowered positions. For example, the container may comprise one or more areas of adhesive securing a front portion of the wrapper to the inner frame front panel. Additionally, or alternatively, in those embodiments in which the inner frame does not comprise an inner frame bottom panel, the wrapper is preferably folded around the consumer goods in a 'U-shaped' configuration, so that the wrapper comprises a wrapper bottom panel depending along fold lines from a wrapper front panel and a wrapper back panel. Using a U-shaped wrapper configuration may eliminate folding, such as envelope folding, from the bottom of the wrapper and reduces the risk of consumer goods falling through the bottom of the wrapper and the bottom of the inner frame.

The particular configuration of the inner frame of containers according to the present invention provides both a spacing of the inner frame back wall from the box portion back wall and a sliding movement of the inner frame with respect to the box portion, while facilitating the manufacture of the container on existing high speed manufacturing machines with minimal modification. In particular, in some embodiments the box portion and the lid portion of containers according to the present invention may be substantially the same as the box portion and the lid portion of a conventional hinge lid container.

Therefore, according to a second aspect of the present invention there is provided an inner frame for a container for consumer goods, the inner frame comprising an inner frame front panel comprising first and second side edges, and first and second inner frame side panels each depending along an inner frame side panel fold line from the first and second inner frame front panel side edges respectively. Each of the first and second inner frame side panels comprises a back edge spaced apart from the respective inner frame side panel fold line. The inner frame further comprises first and second inner frame back panels each depending along a respective inner frame back panel fold line from the first and second inner frame side panels respectively, wherein the first and second inner frame back panels form at least part of an inner frame back wall. A distance between each of the inner frame back panel fold lines and the respective inner frame side panel fold line is less than a maximum width of the respective inner frame side panel between the inner frame side panel fold line and the inner frame side panel back edge so that the minimum spacing between the inner frame front panel and the inner frame back wall is less than the maximum width of each inner frame side panel.

Advantageously, the configuration of the inner frame facilitates manufacture of the inner frame on existing high speed manufacturing machines with minimal modification.

The first and second inner frame back panels may be spaced apart from each other, or they may abut each other. Alternatively, the first and second inner frame back panels preferably at least partially overlap each other. Overlapping the first and second inner frame back panels provides a double thickness for at least a portion of the inner frame back wall, which provides increased strength to the inner frame back wall. In particularly preferred embodiments, a width of each of the first and second inner frame back panels is substantially the same as the distance between the first and second inner frame side panels so that the first and second inner frame back panels overlap each other over substantially the entire surface of each of the first and second inner frame back panels.

When used to form a container for consumer goods, at least one of the first and second inner frame back panels may form a portion of the inner frame back wall that connects to a lid portion.

Alternatively, in some embodiments the first and second inner frame back panels form a lower portion of the inner frame back wall, the inner frame further comprising first and second inner frame end panels each extending along an inner frame end panel fold line from a top edge of the first and second inner frame back panels respectively, wherein the first and second inner frame end panels form an upper portion of the inner frame back wall, and wherein the upper portion of the inner frame back wall is the portion of the inner frame back wall that may connect to a lid portion when the inner frame is used to form a container for consumer goods. Providing an upper portion of the inner frame back wall that may connect to a lid portion and depends along a fold line from a lower portion of the inner frame back wall provides an articulation in the inner frame back wall that may facilitate the required movement of the inner frame back wall during opening and closing of the lid portion in those embodiments in which the inner frame back wall is constructed from a relatively stiff material.

In those embodiments in which the inner frame comprises first and second inner frame end panels, the first and second inner frame end panels preferably at least partially overlap each other, most preferably substantially completely overlap each other. Overlapping the first and second inner frame end panels provides a double thickness for at least part of the upper portion of the inner frame back wall, which provides increased strength to the inner frame back wall.

In further alternative embodiments, the first and second inner frame back panels may form a lower portion of the inner frame back wall, the inner frame further comprising first and second inner frame intermediate panels each extending along an inner frame intermediate panel fold line from a top edge of the first and second inner frame back panels respectively, wherein the first and second inner frame intermediate panels form an intermediate portion of the inner frame back wall. In such embodiments, the inner frame further comprises first and second inner frame end panels each extending along an inner frame end panel fold line from a top edge of the first and second inner frame intermediate panels respectively, wherein the first and second inner frame end panels form an upper portion of the inner frame back wall, and wherein the upper portion of the inner frame back wall is the portion of the inner frame back wall that may connect to a lid portion when the inner frame is used to form a container for consumer goods.

Providing an intermediate portion of the inner frame back wall that depends along a fold line from a lower portion of the inner frame back wall, and an upper portion of the inner frame back wall that depends along a fold line from the intermediate portion of the inner frame back wall provides two articulation points in the inner frame back wall. Providing the inner frame back wall with two articulation points may optimise the translation of rotational movement of a lid portion into a translational sliding movement of the inner frame during opening and closing of the lid portion. Providing the inner frame back wall with two articulation points may also facilitate the required movement of the inner frame back wall during opening and closing of the lid portion in those embodiments in which the inner frame back wall is constructed from a relatively stiff material.

In those embodiments in which the inner frame comprises first and second inner frame intermediate panels and first and second inner frame end panels, the first and second inner frame intermediate panels preferably at least partially overlap each other, most preferably substantially completely overlap each other. Additionally, or alternatively, the first and second inner frame end panels preferably at least partially overlap each other, most preferably substantially completely overlap each other. Overlapping the first and second inner frame intermediate panels provides a double thickness for at least part of the intermediate portion of the inner frame back wall, which provides increased strength to the inner frame back wall. Similarly, overlapping the first and second inner frame end panels provides a double thickness for at least part of the upper portion of the inner frame back wall, which provides increased strength to the inner frame back wall.

In any of the embodiments described above, the first and second inner frame side panels may each comprise a pair of spaced apart cut lines extending perpendicular to the inner frame side panel back edge, wherein each cut line extends between a proximal end at the inner frame side panel back edge and a distal end positioned between the inner frame side panel back edge and the inner frame side panel fold line, and wherein each inner frame back panel fold line extends between the distal ends of the respective pair of spaced apart cut lines. Providing such an arrangement of cut lines and fold lines provides the reduced minimum spacing between the inner frame front panel and the inner frame back wall while retaining a maximum width of the inner frame side panels that is larger than the reduced spaced between the inner frame front panel and the inner frame back wall. This is particularly advantageous in those embodiments in which the maximum width of the inner frame side panels is substantially the same as the width of box portion side walls, when the inner frame is used to construct a container for consumer goods. Providing such an arrangement of cut lines and fold lines may also facilitate the manufacture of the inner frame on high speed manufacturing machines.

In any of the embodiments described above, the inner frame front panel preferably comprises a cut-out portion at a top edge of the inner frame front panel and a tab portion at a bottom end of the inner frame front panel, wherein the cut-out portion and the tab portion have substantially the same size and shape. Providing a cut-out portion at the top of the inner frame front panel may improve access to the consumer goods contained within the inner frame and therefore facilitate removal of the consumer goods from the inner frame by a consumer. Furthermore, providing a corresponding tab portion at the bottom of the inner frame front panel facilitates the manufacture of multiple inner frames from a substantially continuous sheet of material. In particular, a single cut line can be used to form a tab portion of a first inner frame and a cut-out portion of a consecutive inner frame, which reduces or eliminates the generation of waste material.

In those embodiments in which the inner frame comprises a cut-out portion and a tab portion, the tab portion may form an inner frame bottom panel depending along an inner frame bottom panel fold line from a bottom edge of the inner frame front panel. In such embodiments, the inner frame bottom panel forms at least part of an inner frame bottom wall. Advantageously, the inner frame bottom wall may support consumer goods received within the inner frame.

In those embodiments in which the tab portion forms an inner frame bottom panel, the tab portion may further form a third inner frame back panel depending along a third inner frame back panel fold line from a back edge of the inner frame bottom panel, the third inner frame back panel connected to at least one of the first and second inner frame back panels to form part of the inner frame back wall. Advantageously, the third inner frame back panel secures the back edge of the inner frame bottom panel to the inner frame back wall to retain the inner frame bottom panel in position.

As an alternative to those embodiments in which the tab portion forms an inner frame bottom panel, the tab portion may form part of the inner frame front panel. Such embodiments may advantageously reduce the amount of material required to form the inner frame when compared to those embodiments in which the tab portion forms at least an inner frame bottom panel.

In any of the embodiments described above, the inner frame is preferably formed from a single folded laminar blank. Using a single laminar blank to form the inner frame simplifies the manufacture of the inner frame and facilitates manufacture of the inner frame on existing high speed manufacturing machines with minimal modification.

The laminar blank is preferably formed from cardboard, most preferably cardboard having a basis weight of between about 100 grams per square metre and about 350 grams per square metre.

As described above, inner frames formed in accordance with the present invention facilitate the manufacture of multiple inner frames from a substantially continuous sheet material. Therefore, in accordance with a third embodiment of the present invention there is provided a reel of laminar blanks for forming a plurality of inner frames for containers for consumer goods, the reel of laminar blanks formed from a sheet material having a length extending between upstream and downstream ends of the sheet material. The laminar blanks are formed sequentially along the length of the sheet material, wherein a downstream edge of each laminar blank forms an upstream edge of the adjacent laminar blank in a downstream direction so that substantially no waste material exists between adjacent laminar blanks. Each laminar blank is configured so that, when folded, the laminar blank forms an inner frame comprising an inner frame front panel comprising first and second side edges, and first and second inner frame side panels each depending along an inner frame side panel fold line from the first and second inner frame front panel side edges respectively. Each of the first and second inner frame side panels comprises a back edge spaced apart from the respective inner frame side panel fold line. The inner frame further comprises first and second inner frame back panels each depending along a respective inner frame back panel fold line from the first and second inner frame side panels respectively, wherein the first and second inner frame back panels form at least part of an inner frame back wall. A distance between each of the inner frame back panel fold lines and the respective inner frame side panel fold line is less than a maximum width of the respective inner frame side panel between the inner frame side panel fold line and the inner frame side panel back edge so that the minimum spacing between the inner frame front panel and the inner frame back wall is less than the maximum width of each inner frame side panel.

Each laminar blank may be configured so that, when the laminar blank is folded, the first and second inner frame back panels are spaced apart from each other. Alternatively, each laminar blank may be configured so that, when the laminar blank is folded, the first and second inner frame back panels abut each other.

Alternatively, each laminar blank is preferably configured so that, when the laminar blank is folded, the first and second inner frame back panels at least partially overlap each other. Overlapping the first and second inner frame back panels provides a double thickness for at least a portion of the inner frame back wall, which provides increased strength to the inner frame back wall. In particularly preferred embodiments, a width of each of the first and second inner frame back panels is substantially the same as the distance between the first and second inner frame side panels so that the first and second inner frame back panels overlap each other over substantially the entire surface of each of the first and second inner frame back panels.

When used to form a container for consumer goods, at least one of the first and second inner frame back panels may form a portion of the inner frame back wall that connects to a lid portion.

Alternatively, in some embodiments, each laminar blank is configured so that, when the laminar blank is folded, the first and second inner frame back panels form a lower portion of the inner frame back wall, the inner frame further comprising first and second inner frame end panels each extending along an inner frame end panel fold line from a top edge of the first and second inner frame back panels respectively, wherein the first and second inner frame end panels form an upper portion of the inner frame back wall, and wherein the upper portion of the inner frame back wall is the portion of the inner frame back wall that may connect to a lid portion when the inner frame is used to form a container for consumer goods. Providing an upper portion of the inner frame back wall that may connect to a lid portion and depends along a fold line from a lower portion of the inner frame back wall provides an articulation in the inner frame back wall that may facilitate the required movement of the inner frame back wall during opening and closing of the lid portion in those embodiments in which the inner frame back wall is constructed from a relatively stiff material.

In those embodiments in which the inner frame comprises first and second inner frame end panels, the first and second inner frame end panels preferably at least partially overlap each other, most preferably substantially completely overlap each other. Overlapping the first and second inner frame end panels provides a double thickness for at least part of the upper portion of the inner frame back wall, which provides increased strength to the inner frame back wall.

In further alternative embodiments, each laminar blank may be configured so that, when the laminar blank is folded, the first and second inner frame back panels may form a lower portion of the inner frame back wall, the inner frame further comprising first and second inner frame intermediate panels each extending along an inner frame intermediate panel fold line from a top edge of the first and second inner frame back panels respectively, wherein the first and second inner frame intermediate panels form an intermediate portion of the inner frame back wall. In such embodiments, the inner frame further comprises first and second inner frame end panels each extending along an inner frame end panel fold line from a top edge of the first and second inner frame intermediate panels respectively, wherein the first and second inner frame end panels form an upper portion of the inner frame back wall, and wherein the upper portion of the inner frame back wall is the portion of the inner frame back wall that may connect to a lid portion when the inner frame is used to form a container for consumer goods.

Providing an intermediate portion of the inner frame back wall that depends along a fold line from a lower portion of the inner frame back wall, and an upper portion of the inner frame back wall that depends along a fold line from the intermediate portion of the inner frame back wall provides two articulation points in the inner frame back wall. Providing the inner frame back wall with two articulation points may optimise the translation of rotational movement of a lid portion into a translational sliding movement of the inner frame during opening and closing of the lid portion. Providing the inner frame back wall with two articulation points may also facilitate the required movement of the inner frame back wall during opening and closing of the lid portion in those embodiments in which the inner frame back wall is constructed from a relatively stiff material.

In those embodiments in which the inner frame comprises first and second inner frame intermediate panels and first and second inner frame end panels, the first and second inner frame intermediate panels preferably at least partially overlap each other, most preferably substantially completely overlap each other. Additionally, or alternatively, the first and second inner frame end panels preferably at least partially overlap each other, most preferably substantially completely overlap each other. Overlapping the first and second inner frame intermediate panels provides a double thickness for at least part of the intermediate portion of the inner frame back wall, which provides increased strength to the inner frame back wall. Similarly, overlapping the first and second inner frame end panels provides a double thickness for at least part of the upper portion of the inner frame back wall, which provides increased strength to the inner frame back wall.

In any of the embodiments described above, each laminar blank may be configured so that the first and second inner frame side panels may each comprise a pair of spaced apart cut lines extending perpendicular to the inner frame side panel back edge, wherein each cut line extends between a proximal end at the inner frame side panel back edge and a distal end positioned between the inner frame side panel back edge and the inner frame side panel fold line, and wherein each inner frame back panel fold line extends between the distal ends of the respective pair of spaced apart cut lines. Providing such an arrangement of cut lines and fold lines provides the reduced minimum spacing between the inner frame front panel and the inner frame back wall while retaining a maximum width of the inner frame side panels that is larger than the reduced spaced between the inner frame front panel and the inner frame back wall. This is particularly advantageous in those embodiments in which the maximum width of the inner frame side panels is substantially the same as the width of box portion side walls, when the inner frame is used to construct a container for consumer goods. Providing such an arrangement of cut lines and fold lines may also facilitate the manufacture of the inner frame on high speed manufacturing machines.

In any of the embodiments described above, each laminar blank is preferably shaped so that the inner frame front panel comprises a cut-out portion at a top edge of the inner frame front panel and a tab portion at a bottom end of the inner frame front panel, wherein the cut-out portion and the tab portion have substantially the same size and shape. Providing a cut-out portion at the top of the inner frame front panel may improve access to the consumer goods contained within the inner frame and therefore facilitate removal of the consumer goods from the inner frame by a consumer. Furthermore, providing a corresponding tab portion at the bottom of the inner frame front panel facilitates the manufacture of multiple laminar blanks from the sheet material. In particular, a single cut line in the sheet material can be used to form a tab portion of a first inner frame laminar blank and a cut-out portion of a consecutive inner frame laminar blank, which reduces or eliminates the generation of waste material.

In those embodiments in which the inner frame comprises a cut-out portion and a tab portion, each laminar blank may be configured so that, when the laminar blank is folded, the tab portion forms an inner frame bottom panel depending along an inner frame bottom panel fold line from a bottom edge of the inner frame front panel. In such embodiments, the inner frame bottom panel forms at least part of an inner frame bottom wall. Advantageously, the inner frame bottom wall may support consumer goods received within the inner frame.

In those embodiments in which the tab portion forms an inner frame bottom panel, each laminar blank may be configured so that, when the laminar blank is folded, the tab portion further forms a third inner frame back panel depending along a third inner frame back panel fold line from a back edge of the inner frame bottom panel, the third inner frame back panel connected to at least one of the first and second inner frame back panels to form part of the inner frame back wall. Advantageously, the third inner frame back panel secures the back edge of the inner frame bottom panel to the inner frame back wall to retain the inner frame bottom panel in position.

As an alternative to those embodiments in which the tab portion forms an inner frame bottom panel, each laminar blank may be configured so that, when the laminar blank is folded, the tab portion forms part of the inner frame front panel. Such embodiments may advantageously reduce the amount of material required to form the inner frame when compared to those embodiments in which the tab portion forms at least an inner frame bottom panel.

In any of the embodiments described above, the sheet material from which the reel of laminar blanks is formed is preferably formed from cardboard, most preferably cardboard having a basis weight of between about 100 grams per square metre and about 350 grams per square metre.

The invention will now be further described, by way of example only, with respect to the accompanying drawings in which:

FIG. 1 shows a laminar blank 10 for forming an inner frame in accordance with a first embodiment of the present invention. Solid lines represent cut lines and broken lines represent fold lines or scoring lines.

Figure 1:
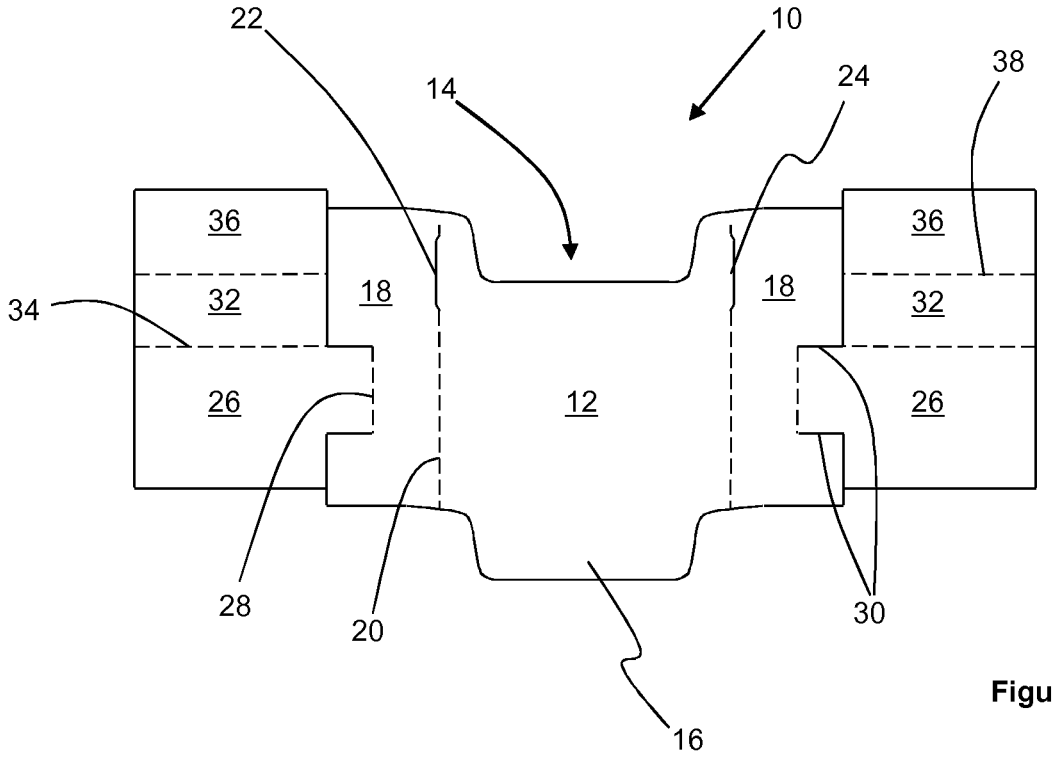
FIG. 1 shows a laminar blank for forming an inner frame in accordance with a first embodiment of the present invention.

The laminar blank 10 comprises an inner frame front panel 12, a cut-out portion 14 at a top edge of the inner frame front panel 12 and a tab portion 16 forming a bottom end of the inner frame front panel 12.

First and second inner frame side panels 18 depend along inner frame side panel fold lines 20 from side edges of the inner frame front panel 12. Cut lines 22 at the top of the inner frame side panel fold lines 20 form ears 24 at the top of the inner frame front panel side edges. When the laminar blank 10 is folded to form an inner frame that is used to form a container for consumer goods, the ears 24 may interact with a lid portion of the container to maintain a desired shape of the lid portion when the lid portion is in a closed position.

First and second inner frame back panels 26 depend along inner frame back panel fold lines 28 from the first and second inner frame side panels 18. Spaced apart cut lines 30 extending from a back edge of each inner frame side panel 18 position the respective inner frame back panel fold line 28 toward the respective inner frame side panel fold line 20 so that a spacing between each inner frame back panel fold line 28 and the respective inner frame side panel fold line 20 is less than the maximum width of the respective inner frame side panel 18 between the back edge of the inner frame side panel 18 and the inner frame side panel fold line 20.

First and second inner frame intermediate panels 32 depend along inner frame intermediate panel fold lines 34 from the top edge of the first and second inner frame back panels 26 respectively. First and second inner frame end panels 36 depend along inner frame end panel fold lines 38 from the top edge of the first and second inner frame intermediate panels 32 respectively.

Figure 2:
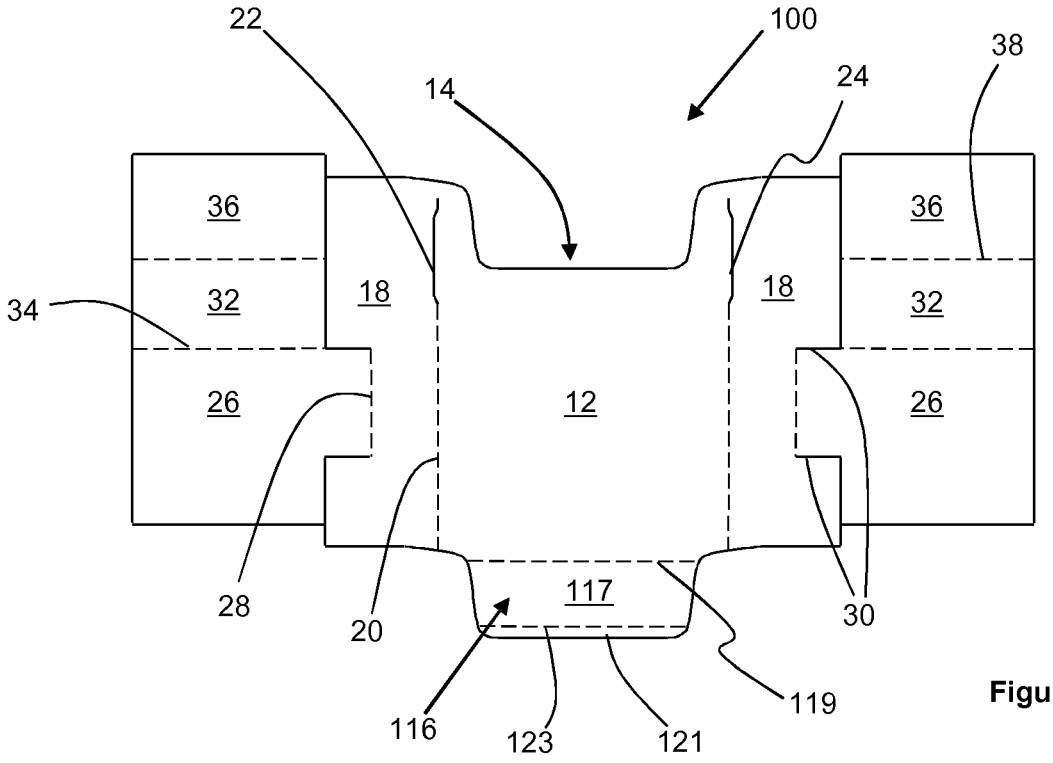
FIG. 2 shows a laminar blank for forming an inner frame in accordance with a second embodiment of the present invention.

FIG. 2 shows a laminar blank 100 for forming an inner frame in accordance with a second embodiment of the present invention. The laminar blank 100 is substantially the same as the laminar blank 10 described with reference to FIG. 1 and like reference numerals are used to designate like parts.

The laminar blank 100 shown in FIG. 2 differs from the laminar blank 10 described with reference to FIG. 1 in the tab portion 116 at the bottom end of the inner frame front panel 12. In particular, the tab portion 116 defines an inner frame bottom panel 117 depending along an inner frame bottom panel fold line 119 from a bottom edge of the inner frame front panel 12, and a third inner frame back panel 121 depending along a third inner frame back panel fold line 123 from a back edge of the inner frame bottom panel 117.

Figure 3:
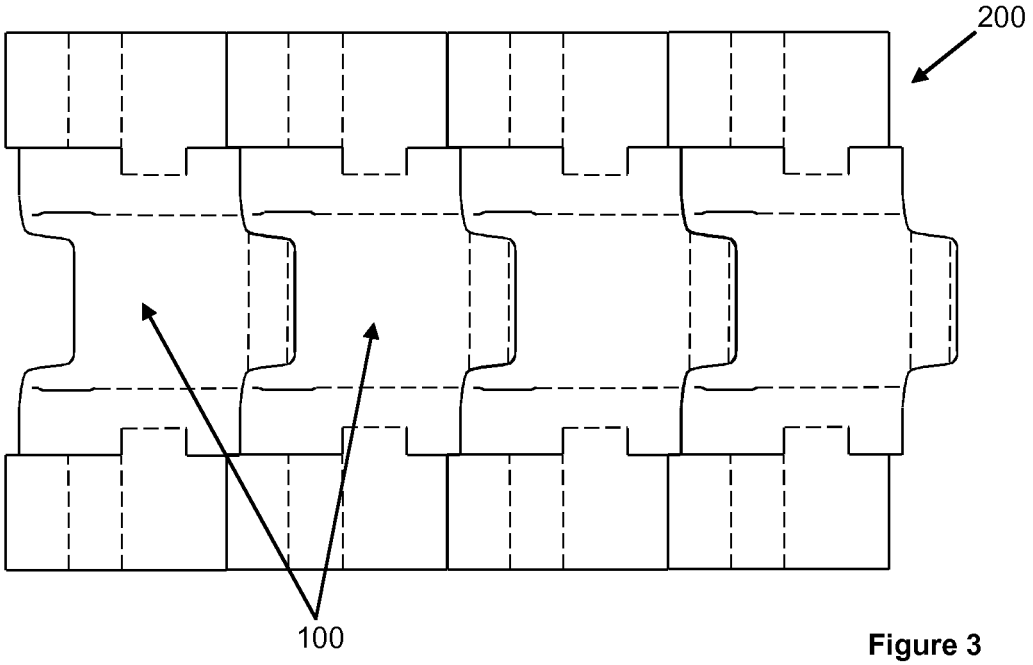
FIG. 3 shows part of a reel of laminar blanks for forming inner frames in accordance with the second embodiment of the present invention.

FIG. 3 shows a portion of a reel 200 of laminar blanks 100 as shown in FIG. 2, the reel of laminar blanks comprising a sheet of cardboard from which multiple laminar blanks 100 are cut. As shown in FIG. 3, the shape of the laminar blanks 100 are such that the cut line forming the downstream edge of each laminar blank forms the upstream edge of the adjacent laminar blank. Therefore, multiple laminar blanks 100 can be cut from the sheet material without generating waste material.

Figure 4:
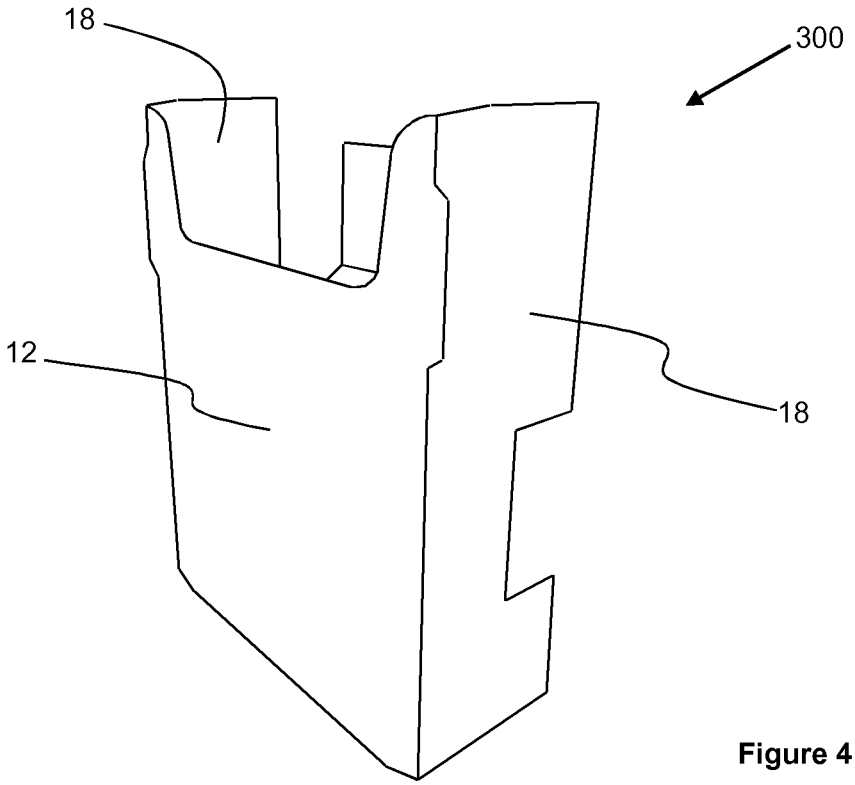
FIG. 4 shows a front perspective view of an inner frame formed from the laminar blank of FIG. 2.
Figure 5:
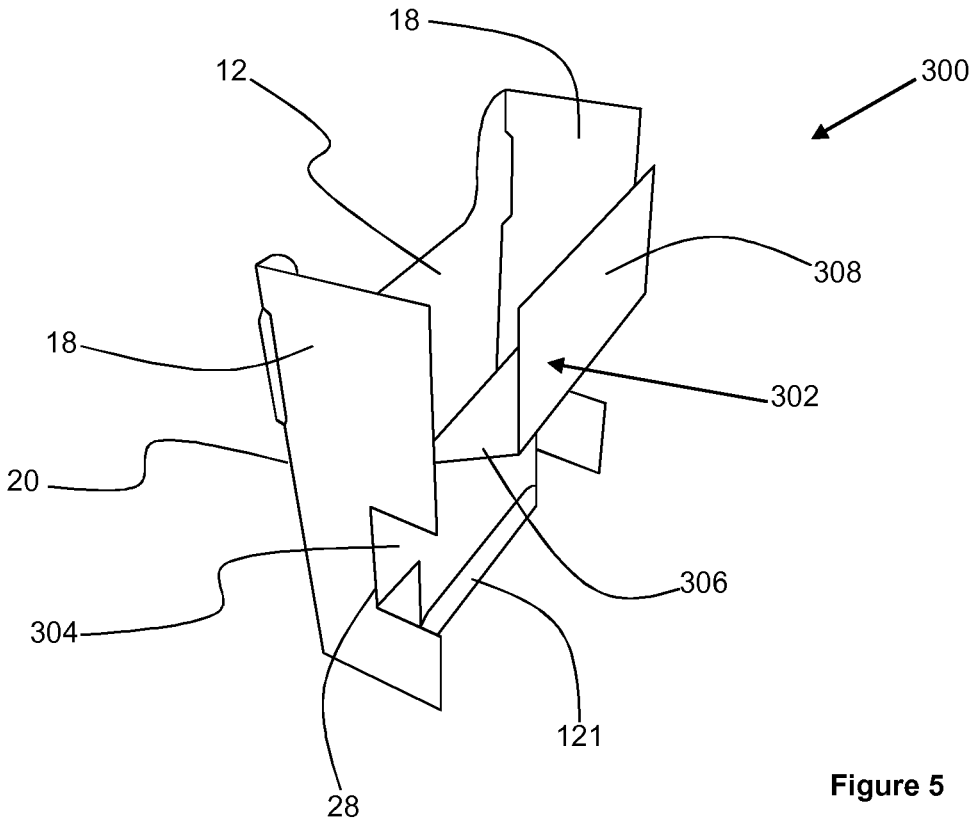
FIG. 5 shows a rear perspective view of the inner frame of FIG. 4.

FIGS. 4 and 5 show an inner frame 300 formed from a laminar blank 100 as shown in FIG. 2. Like reference numerals are used to designate like parts.

The inner frame comprises the inner frame front panel 12, the first and second inner frame side panels 18, the inner frame bottom panel 117, and an inner frame back wall 302. The inner frame back wall 302 comprises a lower portion 304 formed from the first, second and third overlapping inner frame back panels 26, 121. Depending along a fold line from a top edge of the lower portion 304 of the inner frame back wall 302 is an intermediate portion 306 of the inner frame back wall 302, the intermediate portion 306 formed from the first and second overlapping inner frame intermediate panels 32. Depending along a fold line from a top edge of the intermediate portion 306 of the inner frame back wall 302 is an upper portion 308 of the inner frame back wall 302, the upper portion 308 formed from the first and second overlapping inner frame end panels 36.

As shown in FIG. 5, the position of the first and second inner frame back panel fold lines 28 provides a minimum spacing between the inner frame front panel 12 and the inner frame back wall 302 that is less than the maximum width of each inner frame side panel 18 between the inner frame side panel fold line 20 and the back edge of the inner frame side panel 18.

Figure 6:
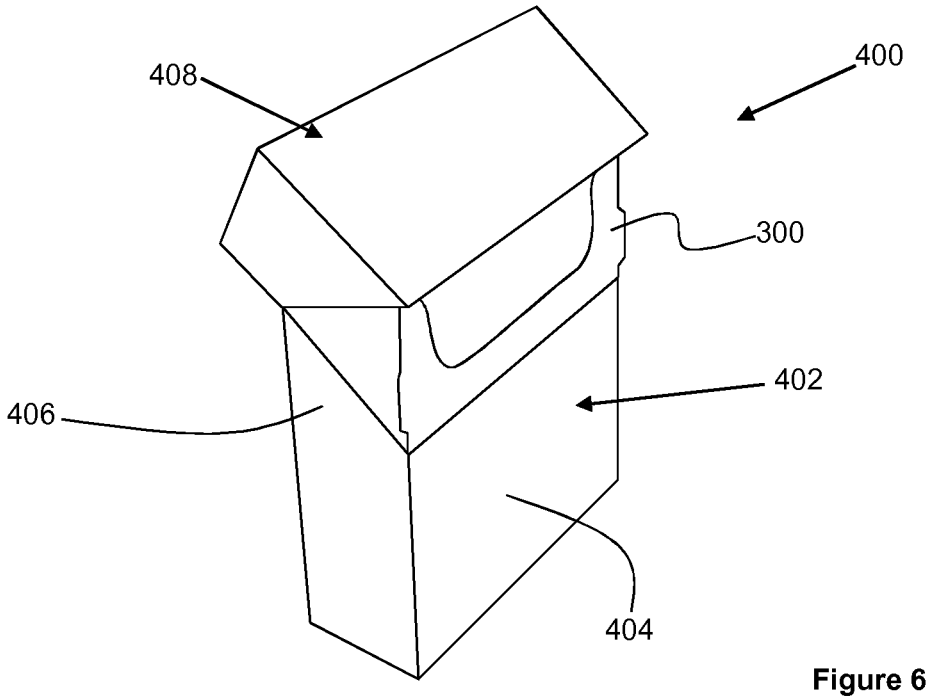
FIG. 6 shows a front perspective view of a container comprising the inner frame of FIGS. 5 and 6, with the lid portion in a partially open configuration.
Figure 7:
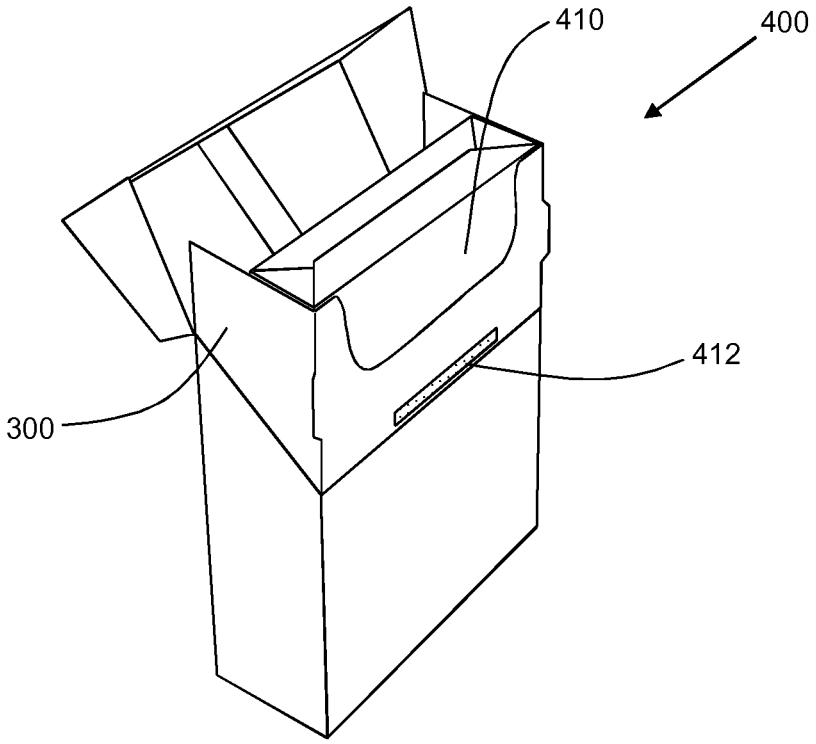
FIG. 7 shows a front perspective view of the container of FIG. 6 with the lid in a fully open configuration.

FIGS. 6 and 7 show a container 400 comprising the inner frame 300 described with reference to FIGS. 4 and 5. The container 400 comprises a box portion 402 having a box portion front wall 404, first and second box portion side walls 406, a box portion back wall and a box portion bottom wall. The container 400 further comprise a lid portion 408 depending along a hinge line from a top edge of the box portion back wall, the lid portion 408 being movable between an open position and a closed position.

The inner frame 300 is slidably received within the box portion 402 and the upper portion 308 of the inner frame back wall 302 is adhered to an inner surface of a back wall of the lid portion 408.

As shown in FIG. 6, which shows the lid portion 408 in a partially open configuration, the inner frame 300 is retained in a lowered positioned within the box portion 402 when the lid is substantially closed. Moving the lid portion 408 into a fully open configuration pulls the inner frame back wall upward and therefore raises the entire inner frame 300 into a raised position, as shown in FIG. 7. Raising the inner frame 300 into the raised position advantageously improves access to a bundle of consumer goods 410 received within the inner frame 300. Raising the inner frame 300 into the raised position may also reveal an indicia 412 provided on the inner frame front panel 12, wherein the indicia 412 is concealed by the box portion front wall 404 when the inner frame 300 is in the lowered position.

As shown in FIG. 7, the volume occupied by the bundle of consumer goods 410 is less than the entire volume of the container 400. However, the reduced spacing between the inner frame front panel 12 and the inner frame back wall 302 advantageously restricts movement of the bundle of consumer goods 410 within the container 400.

The invention claimed is:

1. A container for consumer goods, the container comprising:

a box portion comprising a box portion front wall, a box portion back wall, first and second box portion side walls, and a box portion bottom wall;

a lid portion depending along a hinge line from a top edge of the box portion, wherein the lid portion is moveable about the hinge line between an open position and a closed position; and an inner frame slidably received within the box portion, the inner frame comprising:

an inner frame front panel comprising first and second side edges;

first and second inner frame side panels each depending along an inner frame side panel fold line from the first and second inner frame front panel side edges respectively, each of the first and second inner frame side panels comprising a back edge spaced apart from the respective inner frame side panel fold line; and first and second inner frame back panels each depending along a respective inner frame back panel fold line from the first and second inner frame side panels respectively, wherein the first and second inner frame back panels form at least part of an inner frame back wall, and wherein a distance between each of the inner frame back panel fold lines and the respective inner frame side panel fold line is less than a maximum width of the respective inner frame side panel between the inner frame side panel fold line and the inner frame side panel back edge so that the minimum spacing between the inner frame front panel and the inner frame back wall is less than the maximum width of each inner frame side panel;

wherein a portion of the inner frame back wall is connected to the lid portion so that, when the lid portion is moved about the hinge line, the inner frame slides within the box portion between a raised position when the lid portion is in the open position and a lowered position when the lid portion is in the closed position; and wherein the first and second inner frame back panels form a lower portion of the inner frame back wall, the inner frame further comprising:

first and second inner frame intermediate panels each extending along an inner frame intermediate panel fold line from a top edge of the first and second inner frame back panels respectively, wherein the first and second inner frame intermediate panels form an intermediate portion of the inner frame back wall; and first and second inner frame end panels each extending along an inner frame end panel fold line from a top edge of the first and second inner frame intermediate panels respectively, wherein the first and second inner frame end panels form an upper portion of the inner frame back wall, and wherein the upper portion of the inner frame back wall is the portion of the inner frame back wall connected to the lid portion.

2. The container according to claim 1, wherein the first and second inner frame back panels at least partially overlap each other.

3. The container according to claim 1, wherein the first and second inner frame intermediate panels at least partially overlap each other, and wherein the first and second inner frame end panels at least partially overlap each other.

4. The container according to claim 1, wherein the first and second inner frame side panels each comprise a pair of spaced apart cut lines extending perpendicular to the inner frame side panel back edge, wherein each cut line extends between a proximal end at the inner frame side panel back edge and a distal end positioned between the inner frame side panel back edge and the inner frame side panel fold line, and wherein each inner frame back panel fold line extends between the distal ends of the respective pair of spaced apart cut lines.

5. The container according to claim 1, wherein the lid portion comprises a lid portion back wall depending along the hinge line from a top edge of the box portion back wall, and wherein the portion of the inner frame back wall connected to the lid portion is connected to the lid portion back wall.

6. The container according to claim 1, wherein the inner frame front panel comprises a cut-out portion at a top edge of the inner frame front panel and a tab portion at a bottom end of the inner frame front panel, wherein the cut-out portion and the tab portion have the same size and shape.

7. The container according to claim 6, wherein the tab portion extends parallel to the box portion front wall and forms part of the inner frame front panel.

8. The container according to claim 6, wherein the tab portion forms an inner frame bottom panel depending along an inner frame bottom panel fold line from a bottom edge of the inner frame front panel.

9. The container according to claim 8, wherein the tab portion further forms a third inner frame back panel depending along a third inner frame back panel fold line from a back edge of the inner frame bottom panel, the third inner frame back panel connected to at least one of the first and second inner frame back panels to form part of the inner frame back wall.

10. The container according to claim 1, wherein the inner frame further comprises at least one indicia on the inner frame front panel, wherein the at least one indicia is concealed by the box portion front wall when the inner frame is in the lowered position, and wherein the at least one indicia is revealed when the inner frame slides into the raised position.

11. The container according to claim 1, wherein the width of each inner frame side panel between the respective inner frame side panel fold line and the inner frame side panel back edge is the same as a width of the box portion side walls between an inner surface of the box portion front wall and an inner surface of the box portion back wall.

12. The container according to claim 1, wherein the inner frame is formed from a first folded laminar blank and wherein the box portion and the lid portion are both formed from a second folded laminar blank.

13. The container according to claim 1, further comprising a bundle of aerosol-generating articles received within the inner frame between the inner frame front panel and the inner frame back wall.

* * * * *